United States Patent [19]

Armbruster et al.

[11] Patent Number: 4,506,711

[45] Date of Patent: Mar. 26, 1985

[54] CUTTING ROLLER

[75] Inventors: Gerhard Armbruster; Werner Neubert; Günter Schaal, all of Stuttgart, Fed. Rep. of Germany

[73] Assignee: Robert Bosch GmbH, Stuttgart, Fed. Rep. of Germany

[21] Appl. No.: 532,445

[22] Filed: Sep. 14, 1983

[30] Foreign Application Priority Data

Dec. 14, 1982 [DE] Fed. Rep. of Germany ..... 3246138

[51] Int. Cl.[3] ..... B27G 13/00

[52] U.S. Cl. ..... 144/230; 144/117 R

[58] Field of Search ..... 144/230, 117 R

[56] References Cited

FOREIGN PATENT DOCUMENTS 835347 5/1960 United Kingdom ..... 144/230

*Primary Examiner*—Frederick R. Schmidt

*Assistant Examiner*—J. T. Zatarga

*Attorney, Agent, or Firm*—Michael J. Striker

[57] ABSTRACT

A cutting roller for a hand-operated planing tool includes an elongated primary member and two pressure members, symmetrically surrounding the primary member at two side faces thereof. A plurality of planing knives are clamped between the pressure members and the primary member. The cutting roller is provided with fit elements which are attached to the primary member and fit in the recesses formed in the pressure members. During the assembly the fit members are aligned with the bearings of the cutting roller in the housing of the planing tool and then are attached to the primary member. The planing knives thereby are always aligned in the correct position with respect to the primary member. The pressure members are secured to the primary member by bolts.

14 Claims, 2 Drawing Figures

CUTTING ROLLER

BACKGROUND OF THE INVENTION

The present invention relates in general to hand-operated planing tools, and more particularly to a cutting block or roller which is utilized as a motor-driven cutting element in the hand-operated planing tool.

Cutting rollers of the type under consideration have been known in the art; one of such rollers is disclosed in the European patent application No. 0 048 303. In the construction disclosed in the above application, a number of bolts are provided for locking a guide plate defining the position of the planing knives and a number of additional bolts or screws are provided for rigidly clamping the planing knives by means of pressure members.

In addition to high manufacturing costs of the known construction of the cutting roller, it is disadvantageous that the above-mentioned guide plate could be eventually inadvertently lost by an inexperienced person handling the hand-operated tool. It has been very difficult for an inexperienced person to bring the guide plate again in the correct position in the assembly, to adjust the planing knives in their correct positions and to lock the latter in those positions. Thus, it has been impossible to reach again an ideal position of the planing knives on the cutting block.

SUMMARY OF THE INVENTION

It is an object of the present invention to provide an improved cutting roller for a hand-operated planing tool.

It is another object of the invention to provide a cutting roller in which, by means of relatively low manufacturing and material expense, a uniform alignment of the planing knives in the roller during the whole service life of the cutting roller would be warranted.

These and other objects of the invention are attained by a cutting roller, particularly for a hand-operated planing tool, comprising an elongated primary member having two side faces; a plurality of planing knives; two pressure members attached to said primary member at said side faces to hold the planing knives therebetween, said planing knives being adjustable on the periphery of the roller and securable thereon in position, said pressure members being formed with recesses; and fit members attached to the primary member at said side faces and received in the respective recesses of the pressure members so that the fit members are coupled to the respective pressure members whereby the positions of the pressure members relative to the primary member and thus the positions of the planing knives relative to the primary member are fixed. Due to the fixing of the position of the pressure members relatively to the primary member, by means of fit members, additional guide plates are no longer necessary. Thus, the correct position of the planing knives is always ensured. This locked or secured position is never discontinued.

The fit members may be rigidly attached to the primary member after aligning of the fit members with bearings of the cutting roller in a housing of the hand-operated planing tool during the assembly of the cutting roller. This is particularly advantageous.

The fit members may be arranged at the opposite ends of the elongated primary member.

The fit members may be formed as round plates and may be made out by stamping, injection molding or cast molding.

The cutting roller may further include clamping bolts for attaching the pressure members to the primary member, said bolts having heads which are received in the depressions formed in the pressure members. Thus, the alignment and clamping of the planing knives on the cutting roller are carried out by the fit members and clamping bolts.

The cutting roller according to the invention is easy in manufacturing and reliable in use.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENT

Figure 1:
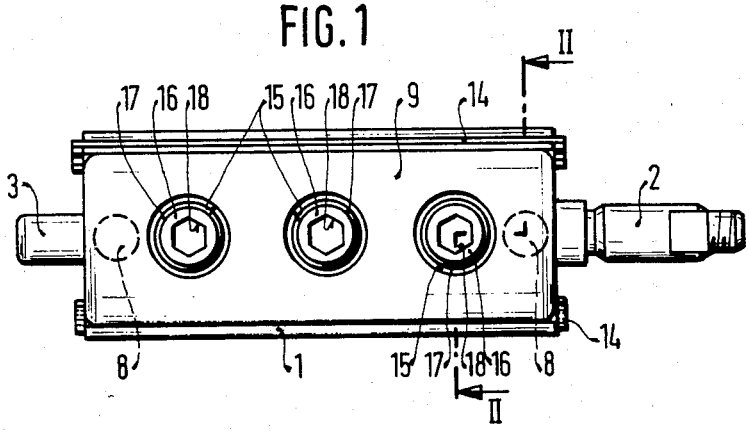
FIG. 1 is a side view of the cutting block or roller for a hand-operated planing tool, according to the invention.
Figure 2:
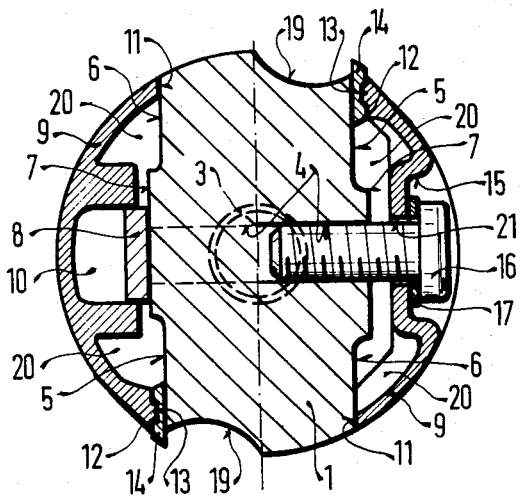
FIG. 2 is a cross-sectional view on the line 11—11 of FIG. 1.

Referring now to the drawings, it will be seen that a cutting block or roller for a hand-operated planing tool includes an elongated primary member 1, the cross-section of which is somewhat circular with two laterally cut faces. The primary member 1, which is mounted on two opposite axles 2 and 3, is formed with a number of parallel threaded through bores 4, which extend normally to the side faces of primary member 1. These faces are formed with gripping surfaces 5, supporting surfaces 6 and receiving surfaces 7; the latter receiving respective fit members 8. As shown in FIG. 1, the fit members 8 are provided at two opposite ends of the elongated primary member 1. Two symmetrically arranged, elongated pressure members 9 surround the primary member 1 at the side faces thereof, so that they complement the circular cross-section of the roller, thus closing the primary member at its two opposite side faces. The pressure members 9 are formed with recesses 10, which are open inwardly towards the primary member 1. These recesses fit on the respective fit members 8, which are attached to the receiving surfaces 7 of the primary member, and thus secure the position of the pressure members 9 against displacement relative to the primary member.

Edges 11 of pressure members 9 are supported against supporting surfaces 6 provided on the side faces of primary member 1. Edges 12 of the pressure member 9 are formed with longitudinal ribs or projections 13, which match and are received in respective longitudinal grooves provided in planing knives 14. Planing knives 14 are clamped between edges 12 with ribs 13 and gripping or clamping surfaces 5, formed on the side faces of the primary member 1.

Circular depressions 15, formed in the pressure members 9 and open in the outward direction, receive the heads of tightening bolts 16 and lock washers 17 assigned to the respective bolts. Each head of bolt 16 is provided with an inner hexagonal recess 18.

Tightening bolts 16, which are screwed into respective threaded through bores 4 extend through holes 21 provided in the pressure members 9. The length of bolts 16 should be so selected that they cannot reach the center of the primary member 1 when inserted into bores 4.

The primary member 1 is formed with grooves 19, each assigned to the respective planing knife 14 clamped between the primary member 1 and the pressure member 9. Chip flow, produced during the operation, is discharged through these grooves. The pressure members 9 are also formed with inwardly open hollows 20 which are necessary for manufacturing purposes. The pressure members 9, which are substantially of segmental cross-section, may be formed by stamping or injection molding or cast molding.

The assembling of the cutting roller is carried out as follows:

The fit members 8, after having been aligned with the bearings of the cutting roller in the housing of the hand-operated planing tool, are welded or glued or soldered, or otherwise rigidly attached to receiving surfaces 7 of the primary member. The utilization of fitting pins to be screwed into the primary member is also possible.

A suitable strip or bar can be pressed into or on the primary member 1, which strip should assume the purpose of the fit member 8, without further adjustment.

During the assembly of the cutting roller, the fit members 8 will be first, by means of a device not illustrated herein, aligned with the bearings of the cutting roller in the housing of the hand-operated planing tool and then these fit members will be, in the correctly found position, rigidly attached to the primary member 1. Thereafter, the pressure members 9 will be applied onto the fit members 8 and the tightening bolts 16 with their lock washers 17 will be screwed into bores 4 through holes 21. When a clearance between the respective gripping surface 5 and the edge 12 of the pressure member 9 is yet sufficiently wide, the planing knife 14 is inserted into that clearance in the direction of longitudinal ribs 13. Lock washers 17 ensure an easy insertion of the planing knives 14 against possible low friction.

If planing knives 14 are brought into the correct position, bolts 16 will be tightened. Thereby planing knives will be rigidly secured to the primary member 1. Should planing knives 14 be turned over or exchanged, the tightening bolts are loosened to allow the planing knives to be displaced. The planing knives 14 will be then either pulled out or turned over, or exchanged for new ones, which will be then again inserted between surfaces 5 and edges 12 in the manner described herein above. The exchange of the knives ends with tightening of the bolts 16. The above-described mode of assembling and re-assembling of the cutting roller warrants that the fit members 8 fit in the recesses 10 of the pressure members 9, longitudinal ribs 13, and grooves in the planing knives always ensure the correct position of the planing knives.

It will be understood that each of the elements described above, or two or more together, may also find a useful application in other types of cutting rollers differing from the types described above.

While the invention has been illustrated and described as embodied in a hand-operated planing tool, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A cutting roller, particularly for a hand-operated planing tool, comprising an elongated primary member having two side faces; a plurality of planing knives; two pressure members attached to said primary member at said side faces to hold the planing knives therebetween, said planing knives being adjustable on the periphery of the roller and securable thereon in position, said pressure members being formed with recesses; and fit members attached to the primary member at said side faces and received in the respective recesses of the pressure members so that the fit members are coupled to the respective pressure members, whereby the positions of the pressure members relative to the primary member and thus the positions of the planing knives relative to the primary member are fixed.

2. The cutting roller as defined in claim 1, wherein said fit members are rigidly attached to the primary member after aligning of the fit members with bearings of the cutting roller in a housing of the hand-operated planing tool during the assembly of the cutting roller.

3. The cutting roller as defined in claim 2, wherein said fit members are glued to the primary member.

4. The cutting roller as defined in claim 2, wherein said fit members are welded to the primary member.

5. The cutting roller as defined in claim 2, wherein said fit members are soldered to the primary member.

6. The cutting roller as defined in claim 1, wherein said elongated primary member has two opposite ends, said fit members being arranged in the vicinity of said opposite ends.

7. The cutting roller as defined in claim 1, wherein said fit members are round plates.

8. The cutting roller as defined in claim 1, wherein said pressure members have a substantially segmental cross-section and are attached to the primary member at the side faces thereof, so that they form the body of the cutting roller.

9. The cutting roller as defined in claim 1, wherein said pressure members are formed with hollows open towards the primary member.

10. The cutting roller as defined in claim 1, wherein said pressure members are formed with depressions.

11. The cutting roller as defined in claim 10, further including tightening bolts for attaching said pressure members to said primary member, said bolts having heads which are received in said depressions.

12. The cutting roller as defined in claim 1, wherein said pressure members are made by stamping.

13. The cutting roller as defined in claim 1, wherein said pressure members are made by injection molding.

14. The cutting roller as defined in claim 1, wherein said pressure members are made by cast molding.

* * * * *